US006798129B2

(12) United States Patent
Roh

(10) Patent No.: US 6,798,129 B2
(45) Date of Patent: Sep. 28, 2004

(54) ELECTRON GUN HAVING IMPROVED ELECTRODE SUPPORT STRUCTURE

(75) Inventor: Byoung-kon Roh, Ulsan Metropolitan (KR)

(73) Assignee: Samsung SDI Co., Ltd., Suwon (KR)

( * ) Notice: Subject to any disclaimer, the term of this patent is extended or adjusted under 35 U.S.C. 154(b) by 61 days.

(21) Appl. No.: 10/188,045

(22) Filed: Jul. 3, 2002

(65) Prior Publication Data

US 2003/0006690 A1 Jan. 9, 2003

(30) Foreign Application Priority Data

Jul. 5, 2001 (KR) ..... 2001-40048

(51) Int. Cl.[7] ..... H07J 29/50
(52) U.S. Cl. ..... 313/414; 313/416; 313/449
(58) Field of Search ..... 313/412, 414, 313/416, 425, 426, 449, 452, 460, 409

(56) References Cited

U.S. PATENT DOCUMENTS 5,208,507 A * 5/1993 Jung ..... 313/414
5,581,147 A * 12/1996 Koh et al. ..... 313/414
6,222,310 B1 * 4/2001 Mera et al. ..... 313/409
6,541,903 B1 * 4/2003 Kagabu et al. ..... 313/421
2001/0015611 A1 * 8/2001 Sung ..... 313/417

FOREIGN PATENT DOCUMENTS

JP 2000-348637 12/2000

* cited by examiner

*Primary Examiner*—James Vannucci
*Assistant Examiner*—Jimmy T. Vu
(74) *Attorney, Agent, or Firm*—Leydig, Voit & Mayer, Ltd.

(57) ABSTRACT

An electron gun for a CRT includes a pair of bead glasses separated from and parallel to each other, supporting electrodes of the electron gun. An electrode has electron beam passing holes and at least one electrode support embedded in each bead glass. The electrode support includes at least two embedding protrusions embedded in the bead glass. One of the protrusions is longer than the other protrusion. The structure of the electrode support is improved so cracks in a bead glass during a beading process do not occur and twisting in a gap between the bead glass and an electrode support is minimized. There is no gap between the bead glass and the electrode, so leakage current does not flow between the electrodes, improving the lifetime of electrical features of the electron gun.

15 Claims, 5 Drawing Sheets

ELECTRON GUN HAVING IMPROVED ELECTRODE SUPPORT STRUCTURE

BACKGROUND OF THE INVENTION

1. Field of the Invention

The present invention relates to an electron gun for a CRT (cathode ray tube), and, more particularly, to an electrode of an electron gun embedded in a bead glass, and an electron gun including the electrode.

2. Description of the Related Art

In a typical electron gun for a CRT, electron beam passing holes in electrodes are arranged in-line, i.e., have centers lying on a straight line, and the electron gun including the electrodes is installed in a neck of the CRT. The electrodes have various shapes, such as a plate, a cylinder, and a cup, and are coaxially arranged and separated by spacers. Opposite edges of the electrodes are fixedly supported by bead glass.

Fixing the electrodes to support bead glasses is referred to as a beading process. In the beading process, at least one pair of supports along an edge of an electrode is embedded in the bead glass while the bead glass is half melted with a flame. "Half-melted" means the bead glass is sufficiently softened with heat to flow viscously in response to applied pressure, but the bead glass is not fully melted, i.e., is not liquid. There have been many attempts to improve the degree of bonding of the bead glass to the support that is embedded. The technology of making the structure of a support to be embedded in the bead glass of electrodes is complicated, with the goal that the supports not be easily separated from the bead glass. However, when the structure of the support is complex, cracks occur in the bead glass in the embedding step, causing deterioration of an electron gun.

To solve this problem, according to Japanese Patent Publication No. 2000-348637, the structure of at least one of a plurality of support pairs, which are not plate shaped but three-dimensional, are installed parallel to one another on the electrodes. The structure is kept simple to reduce stress applied to the bead glass so that cracks generated in the embedding step can be reduced. However, this technology has a limit since it does not improve the structure of the support that is embedded in the bead glass. In other words, in the electrodes, the support of each electrode has a pair of protrusions to be embedded in the bead glass and the protrusions are inwardly bent and face each other. In the support having a simplified shape, the number of branches are reduced but the bent shape itself is not changed.

In a complicated electrode support or inwardly bent electrode support, since the bead glass in a half-melted state is injected between the embedding protrusions, the viscous half-melted bead glass is not smoothly injected.

When a bead glass having a beveled outside corner is used to support electrodes, and the beveled portion and the outer one of embedding protrusions close to each other, support strength of the bead glass is weakened. To avoid this weakness, the bead glass is made thicker with the result that the electrode assembly is not compact.

FIG. 1 shows an electrode 10 supported by a bead glass. Referring to FIG. 1, in a typical electrode of an electron gun for a CRT, three electrode beam passing holes 12 for electron beams respectively producing red, green, and blue light, are located in-line at a central portion of the electrode. A support at each of upper and lower edges of the electrode is embedded in a bead glass 14. The bead glass 14 has a thickness T between surfaces generally parallel to a line joining the centers of the electron beam passing holes 12. The bead glass 14 includes beveled surfaces 14*a*, oblique to the surfaces between which the thickness is measured. To join the supports and the bead glass, a plurality of electrodes having plate, cylinder, and cup shapes, and arranged parallel to one another, are fixed in a jig by interposing spacers between the electrodes. Then, the bead glass in a half melted state is pressed toward a portion of the electrode at the support. Thus, the support is inserted into and fixed by the bead glass so that the electrodes are supported.

When the support of the electrode is pressed into the half melted bead glass, the bead glass flows between embedding protrusions 16*a* and 16*b* of the support, as indicated by arrows in FIG. 1. Since the bead glass is not completely melted and exhibits a certain degree of viscosity, the bead glass provides a predetermined resistance to the embedding protrusions 16*a* and 16*b*. The bead glass may not be sufficiently inserted into an inner curved portion 18 between the embedding protrusions 16*a* and 16*b*. If an excess pressure is applied to insert the half melted bead glass into the internal curved portion 18, cracks are generated. On the other hand, a gap between the bead glass and the electrode is produced if the half melted bead glass is not sufficiently injected between the protrusions 16*a* and 16*b*. The gap supports the flow of a leakage current in the electron gun.

Also, as shown in FIG. 1, the thickness T of the bead glass 14 cannot be reduced since a minimum distance i is required between the beveled portion 14*a* of the bead glass and the outer embedding protrusion 16*b* of the support to ensure adequate strength of the bead glass.

SUMMARY OF THE INVENTION

To solve the above-described problems, it is an object of the present invention to provide an electron gun in which the structure of an embedding portion of an electrode is improved, preventing cracking in a bead glass during the beading process and minimizing twisting in a gap between the bead glass and an electrode support.

It is another object of the present invention to provide an electron gun in which a gap between the bead glass and the electrode is minimized and the degree of bonding is improved so that arcing resistance inside a CRT is improved and the leakage current is prevented.

It is yet another object of the present invention to provide an electron gun for a CRT in which the size of the bead glass is reduced while maintaining embedding strength by changing the shape of an embedding protrusion of an electrode support.

To achieve the above object, an electron gun for a CRT comprises a plurality of electrodes arranged sequentially and having a plurality of electron beam passing holes, and a pair of bead glasses separated from and parallel to each other, supporting the plurality of electrodes of the electron gun, wherein at least one of the electrodes includes at least two electrode supports respectively embedded in the respective bead glasses, each electrode support comprising first and second embedding protrusions embedded in one of the bead glasses, the first embedding protrusion protruding further from the electrode than the second embedding protrusion.

Each bead glass includes a first planar surface and a second planar surface oblique to the first planar surface and generally parallel to a straight line tangent to the first and second embedding protrusions It is preferred in the present invention that an angle between the straight line tangent to both the first and second embedding protrusions and a line connecting the electron beam passing holes is within a range of 15° through 45°.

It is preferred in the present invention that the first and second protrusions are separated by a width varying with distance from the electrode and include an inlet where the bead glass flows between the first and second embedding protrusions, and the inlet has a width at least 95% of a maximum width between the first and second embedding protrusions.

It is preferred in the present invention that the first embedding protrusion is closer to a center portion of the electrode than the second embedding protrusion.

It is preferred in the present invention the electrode has a depth as well as a height and includes an auxiliary electrode support embedded in one of the bead glasses and located on a surface of the electrode, facing the bead glass.

An electron gun according to the invention includes a plurality of electrodes arranged sequentially and having a plurality of electron beam passing holes, and first and second bead glasses separated from and parallel to each other, supporting the plurality of electrodes of the electron gun, wherein at least one of the electrodes includes at least first and second electrode supports respectively embedded in the first and second bead glasses, the first electrode support comprising a central embedding protrusion embedded in the first bead glass and first and second embedding protrusions on opposite sides of the central embedding protrusion and embedded in the first bead glass, the central protrusion protruding farther from the electrode than the first and second embedding protrusions.

It is preferred in the present invention that the auxiliary electrode support comprises at least two auxiliary embedding protrusions and at least one of the auxiliary embedding protrusions extends further from the electrode than the other auxiliary embedding protrusion.

BRIEF DESCRIPTION OF THE DRAWINGS

The above objects and advantages of the present invention will become more apparent by describing in detail preferred embodiments with reference to the attached drawings in which.

The same reference numbers indicate the same elements in all figures.

DETAILED DESCRIPTION OF THE INVENTION

Figure 1:
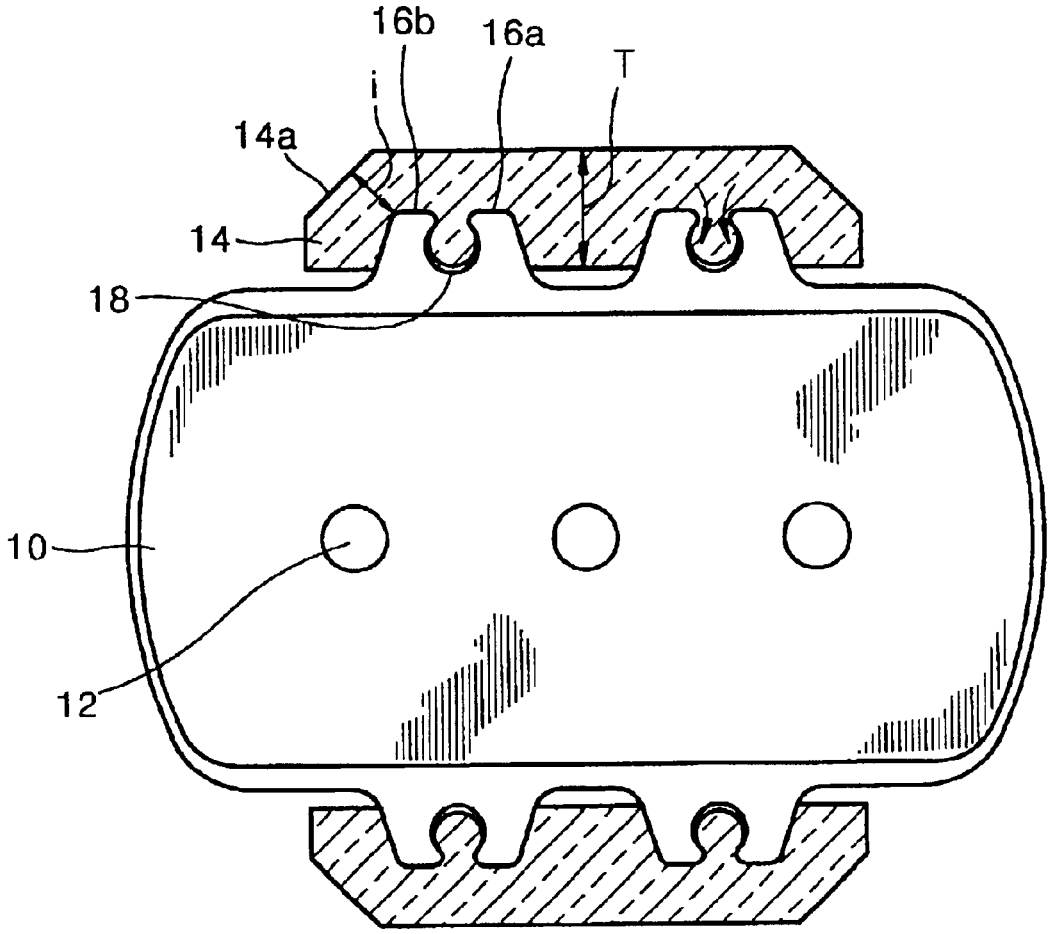
FIG. 1 (PRIOR ART)
FIG. 1 is a view showing how a conventional electrode of an electron gun is supported.
Figure 2A:
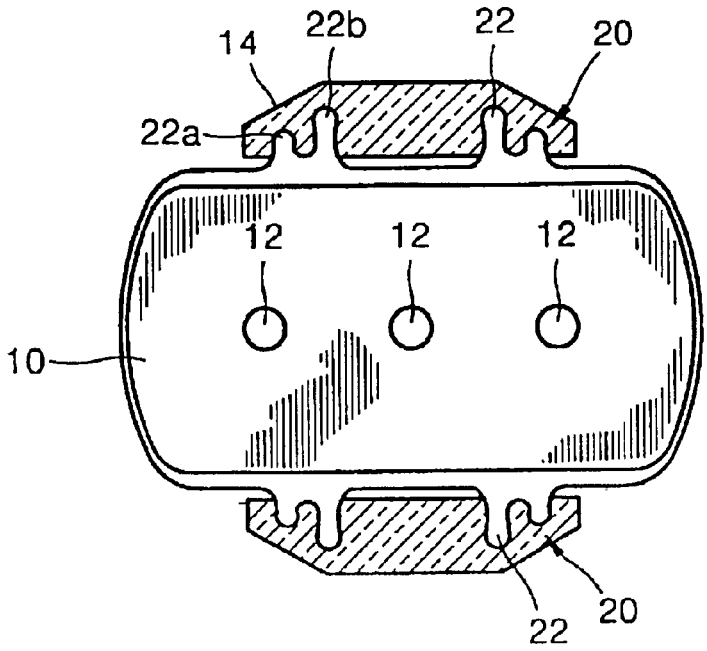
FIG. 2A is a view of an electrode according to a preferred embodiment of the present invention.

An electrode according to the present invention includes at least one pair of supports and each support includes at least two embedding protrusions 22. A first embodiment of the present invention is shown in FIG. 2A. In that embodiment, a support 20 embedded in a bead glass 14 includes a pair of embedding protrusions 22, specifically embedding protrusions 22*a* and 22*b*. When the support 20 is embedded in the bead glass 14, with the bead glass in a half melted state, as schematically shown from FIG. 2B, the bead glass 14 is forced into an internally curved portion 24 between the two embedding protrusions 22*a* and 22*b*. To facilitate the flow of the half melted bead glass 14, the embedding protrusions provide a directional force to the half melted bead glass 14. That is, when the support is pressed into the half melted bead glass, the bead glass flows from one of the embedding protrusions toward the other embedding protrusion and slowly flows into the gap, filling the space between the protrusions. To provide this flow, according to a preferred embodiment of the present invention, as shown from FIG. 2B, one of the embedding protrusions 22*b* is longer than the other embedding protrusion 22*a*. The half melted bead glass flows in a direction from the longer embedding protrusion 22*b* toward the shorter embedding protrusion 22*a*, as indicated by the arrow in FIG. 2B. The half melted bead glass 14 flows deeply into the internally curved portion 24 between the two embedding protrusions, although the embedding protrusions 22 are inwardly bent. The injected bead glass 14 first flows to the depth of the relatively shorter embedding protrusion 22*a* and then flows to the depth of the relatively longer embedding protrusion 22*b*, thus filling the gap between the protrusions 22*a* and 22*b*, all the way to internally curved portion 24.

Figure 2B:
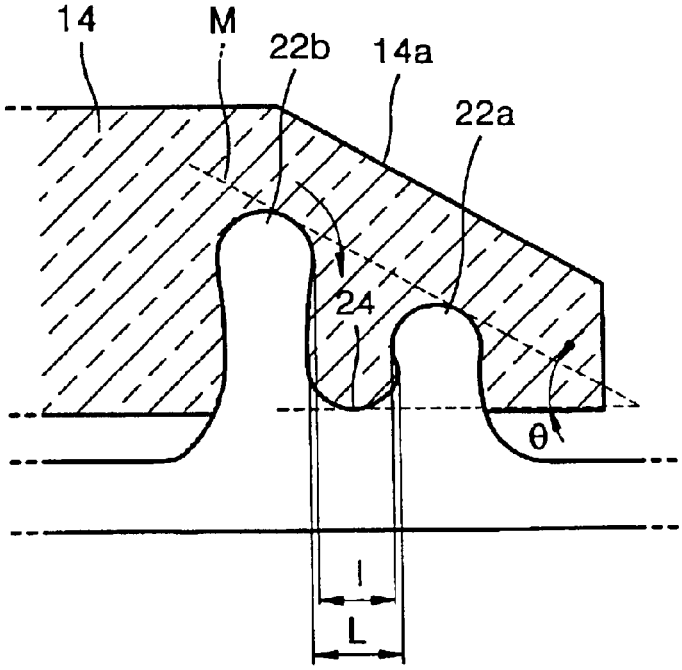
FIGS. 2B and 2C are enlarged detail views showing portions of the electrode of FIG. 2A.

As shown from FIG. 2B, of the two embedding protrusions 22, the embedding protrusion 22*b* closer to the central portion of the electrode 10 is longer than the embedding protrusion 22*a*. By providing this arrangement, when the half melted bead glass 14 flows, a directional force is applied to the half melted bead glass 14 so that the half melted bead glass 14 flows from the inside toward the outside, that is, from the central portion of the electrode toward the outside of the electrode. Thus, by making the inner embedding protrusion longer, stress during flow is reduced and cracks in the bead glass can be prevented.

In making the lengths of the embedding protrusions 22*a* and 22*b* different to provide directivity to the flow of the half melted bead glass, the difference in lengths is limited. An angle between a line tangent to both the longer embedding protrusion 22*b* and the shorter embedding protrusion 22*a*, and a line connecting the centers of the electron beam passing holes 12 is confined to a preferred range to achieve the desired result. As shown in FIG. 2B, the angle θ formed by a straight line M tangent to both the longer embedding protrusion 22*b* and the shorter embedding protrusion 22*a* and a line connecting centers of the electron beam passing holes, or parallel to the line connecting the centers of the beam passing holes, is an acute angle, preferably between 15° and 45°°. When the angle θ is less than 15°, the directivity of the flow of the half melted bead glass provided by making the lengths of the embedding protrusions 22*a* and 22*b* different is not sufficiently achieved. When the angle θ is greater than 45°, the shorter embedding protrusion 22*a* does not provide adequate support to the electrode from the bead glass.

To improve the flow of the half melted bead glass, according to a preferred embodiment of the present invention, the width of a gap between the pair of the embedding protrusions is controlled. As shown in FIG. 2B, assuming that the width of an inlet for the bead glass between the pair of the embedding protrusions 22*a* and 22*b* is I and the maximum width of the gap between the pair of protrusions is L, I is at least 95% of L. That is, when I is no smaller than 95% of L, the half melted bead glass flows sufficiently to fill the space between the embedding protrusions 22*a* and 22*b* and reach the internally curved portion 24. However, I is preferably not larger than L. If I is larger than L, the supporting strength of the electrode support in the bead glass may be weakened.

Figure 2C:
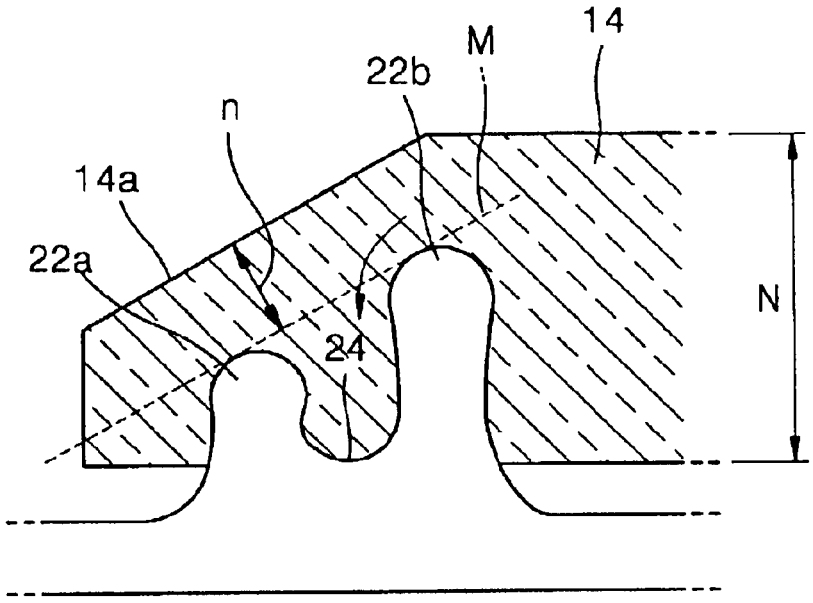

The lengths of the embedding protrusions can be determined in relation to a beveled portion of the bead glass. As can be seen from FIG. 2C, the bead glass has a thickness N between two generally parallel surfaces. These surfaces are parallel to a line connecting centers of the electron beam passing holes 12. Lengths of the embedding protrusions 22*a* and 22*b* can be adjusted so that a straight line M, tangent to both the longer embedding protrusion 22*b* and the shorter embedding protrusion 22*a* is generally parallel to a beveled portion 14*a* of the bead glass. Since the distance n between the beveled portion 14*a* and the tangent to the embedding protrusions 22*a* and 22*b* of the support is constant, the support strength of the bead glass is uniform and the thickness N of the bead glass 14 can be reduced.

Figure 3A:
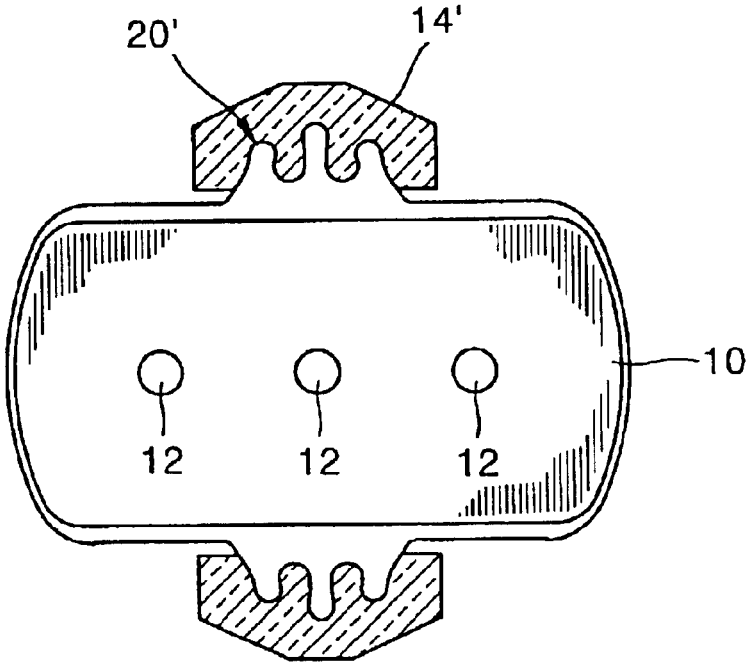
FIG. 3A is a view of an electrode according to another preferred embodiment of the present invention.
Figure 3B:
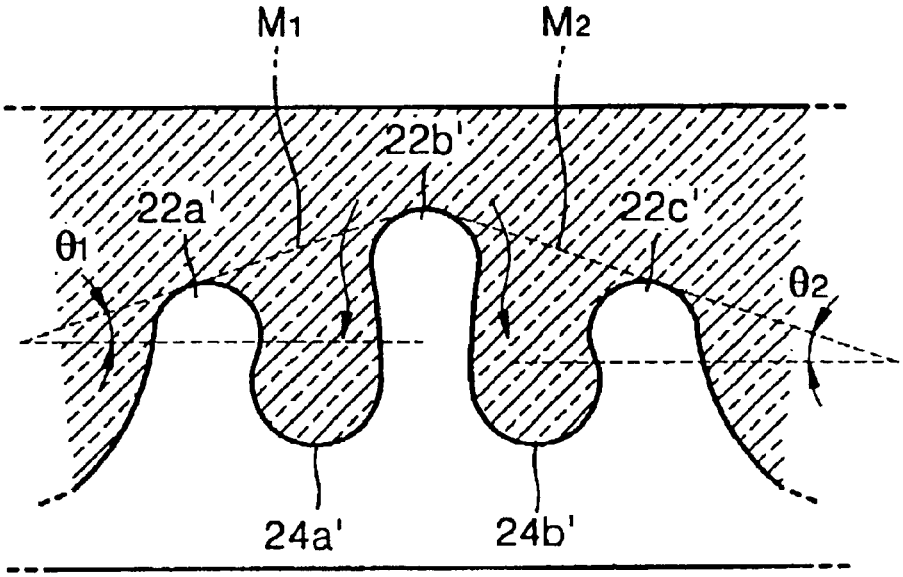
FIGS. 3B and 3C are enlarged detail views showing the electrode of FIG. 3A.
Figure 3C:
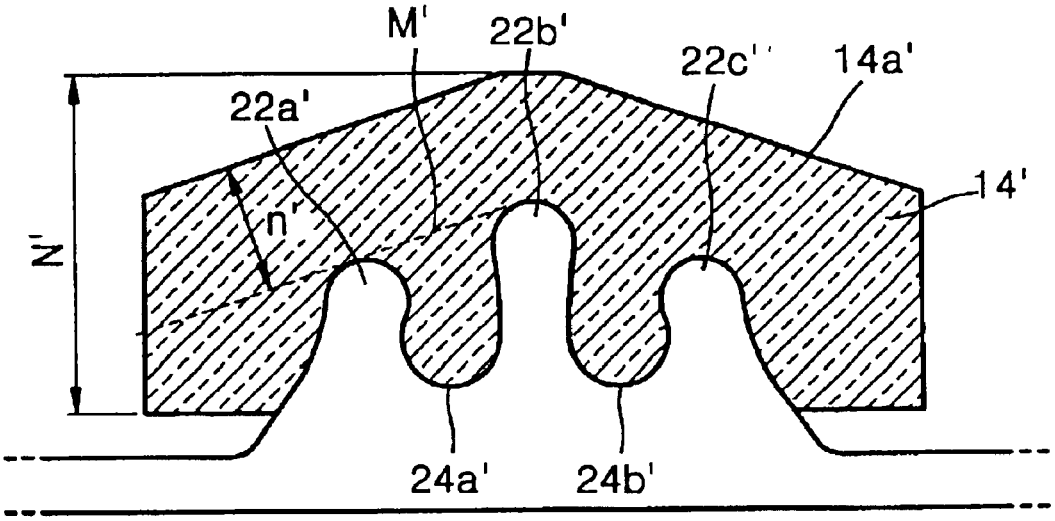

FIGS. 3A through 3C show the structure of an electrode support according to another preferred embodiment of the present invention. An electrode support 20' includes three embedding protrusions 22*a*', 22*b*', and 22*c*'. One or a plurality of the electrode supports 20' can be located on each edge of the electrode. As shown in FIG. 3B, the embedding protrusion 22*b*', at the center of the three embedding protrusions, is longer than the other embedding protrusions 22*a*' and 22*c*', so that half melted glass flows toward both outside protrusions 22*a*' and 22*c*' as indicated by the arrows in FIG. 3B. Accordingly, the half melted bead glass flows into internally curved portions 24*a*' and 24*b*', and resistance to the flow is greatly reduced. Here, the angles $\theta_1$ and $\theta_2$ made by the straight lines $M_1$ and $M_2$ tangent to the respective embedding protrusions, that is, the longer embedding protrusion 22*b*' and each of the shorter embedding protrusions 22*a*' and 22*c*', and a line connecting the centers of the electron beam passing holes, or parallel to the line connecting the centers of the electron beam passing holes 12, (a horizontal line in the drawing) are preferably within the range from 15° to 45°. The reason for this angular range is the same as in the first embodiment, i.e., to achieve the described flow of bead glass without loss of support of the electrode. Also, in the electrode support having the illustrated structure, the width of a gap between the respective embedding protrusions can be adjusted with respect to an inlet for the bead glass flow as already described for the first embodiment. That is, the gap between the embedding protrusions 22*a*' and 22*b*', and the gap between the embedding protrusions 22*b*' and 22*c*', have respective inlets with widths at least 95% of the maximum width between the pairs of protrusions, moving in the direction of the internally curved portions 24*a*' and 24*b*'. Thus, the half melted bead glass can flow smoothly as indicated by the arrows in FIG. 3B.

The lengths of the embedding protrusions 22*a*', 22*b*', and 22*c*' can be determined in relation with the shape of the beveled portion 14*a*' of the bead glass 14' as indicated with reference to FIG. 3C. That is, as shown in FIG. 3C, straight lines M' respectively tangent to the longer embedding protrusion 22*b*' and each of the shorter embedding protrusions 22*a*' and 22*c*', respectively, are generally parallel to the surfaces of the beveled portions 14*a*' of the bead glass 14'. In other words, by adjusting the length of the embedding protrusions 22*a*', 22*b*', and 22*c*' such that the straight lines M' tangent to the longer embedding protrusion 22*b*' and the shorter embedding protrusion 22*a*', and the longer embedding protrusion 22*b*' and the shorter embedding protrusion 22*c*', are parallel to the surfaces of the beveled portions 14*a*' of the bead glass 14, the distances n' between the beveled portions 14*a*' and the embedding protrusions 22 *a*', 22*b*', and 22*c*' are constant. Thus, support strength is uniform and the thickness N' of the bead glass 14' can be reduced.

Figure 4A:
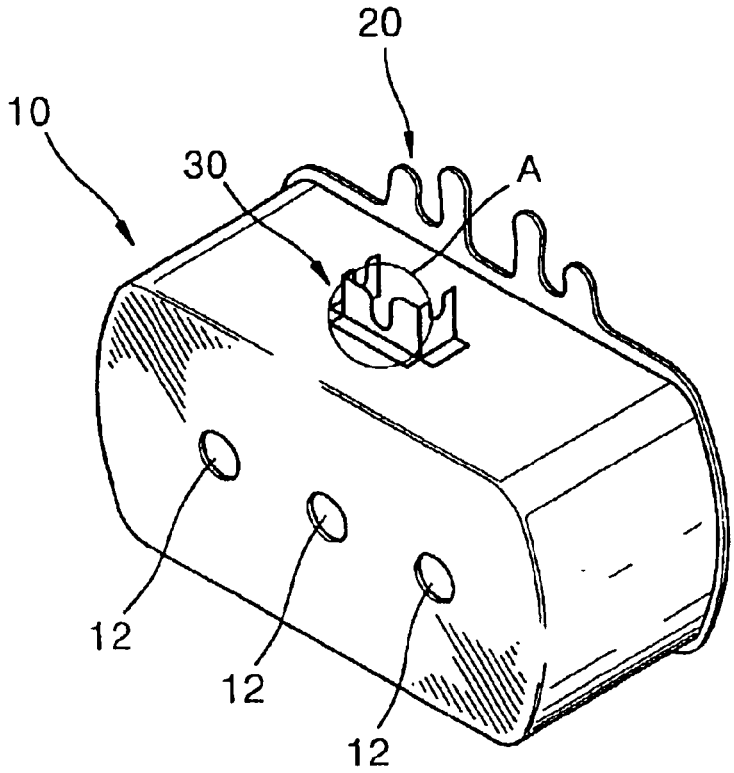
FIG. 4A is a perspective view of an electrode according to yet another preferred embodiment of the present invention.
Figure 4B:
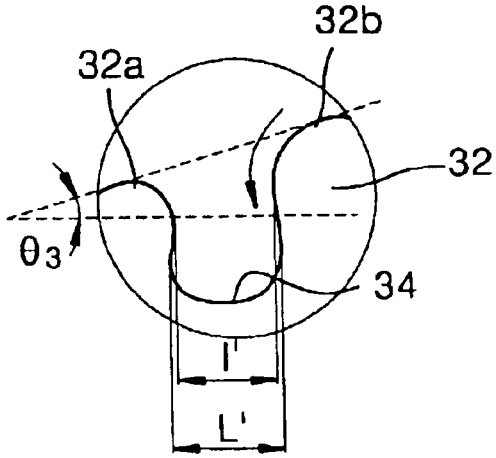
FIG. 4B is a an enlarged view showing a portion A of FIG. 4A.

The support of the present invention can be applied not only to a plate electrode as in FIGS. 2A–3C, but also to a cup or cylindrical electrode having a three-dimensional structure. In an electrode having such a three-dimensional structure, as shown in FIG. 4A, the electrode support 20 is located at one edge of the electrode. An auxiliary support 30 can also be included to provide a supporting force at a second embedding portion. The auxiliary support 30 includes embedding protrusions having different lengths with respect to the electrode, as in the embedding portions of FIGS. 2A–3C. As shown in FIG. 4B, showing an enlargement of portion A of FIG. 4A, in order to guide the flow of the half melted bead glass in a direction indicated by the arrow, at least one of the embedding protrusions 32 of the auxiliary support 30 is longer than the other embedding protrusions. Accordingly, the half melted bead glass flows from the longer embedding protrusion 32*b* toward the shorter embedding protrusion 32*a*. Also, the width of a gap between the embedding protrusions 32*a* and 32*b* of the auxiliary support 30 varies to facilitate the flow of the half melted bead glass. That is, the width I' at an inlet portion is at least 95% of the inner maximum width L'. An angle $\theta_3$ between a line tangent to the longer embedding protrusion 32*b* and the shorter embedding protrusion 32*a* and a line connecting the centers of the electron beam passing holes 12 or parallel to that line is preferably between 15° and 45 °.

According to the present invention, one of the embedding protrusions is longer than another embedding protrusion so that, when the support is inserted into the half melted bead glass, the half melted bead glass flows into the gap between the protrusions with a directivity from one side toward another side and is smoothly injected to the full depth of the gap. Accordingly, cracking of the bead glass is remarkably reduced. Also, twisting due to a gap between the bead glass and the electrode support, if the bead glass does not sufficiently flow, is prevented. Furthermore, plugging of shadow mask holes by glass fragments due to the cracking of bead glass is reduced.

Since there is no gap between the bead glass and the electrode support, current leakage between electrodes mounted on the same bead glass is prevented, improving the lifetime of the electrical characteristics of the device including the electrodes. Further, as the shape of the electrode support corresponds to the shape of the surface of the beveled portion of the bead glass, the thickness of the bead glass can be reduced.

While this invention has been particularly shown and described with reference to preferred embodiments, it will be understood by those skilled in the art that various changes in form and details may be made without departing from the spirit and scope of the invention as defined by the appended claims.

What is claimed is:

1. An electron gun for a CRT comprising:

a plurality of electrodes arranged sequentially along a first direction, each electrode having a plurality of electron beam passing holes living along respective first axes, the first axes being transverse to the first direction, and each electrode including a respective central axis passing through a center of a central beam passing hole of the electrode, the central axes being transverse to the first direction and to the first axes; and a pair of bead glasses separated from and parallel to each other, supporting the plurality of electrodes of the electron gun, wherein one of the electrodes includes at least two electrode supports respectively embedded in the respective bead glasses, each electrode support comprising first and second embedding protrusions embedded in one of the bead glasses, the first embedding protrusion protruding further from the electrode than the second embedding protrusion, the first and second embedding portions being asymmetrically located relative to the central axis of the electrode.

2. The electron gun as claimed in claim 1, wherein each bead glass includes a first planar surface and a second planar surface oblique to the first planar surface and generally parallel to a straight line tangent to the first and second embedding protrusions.

3. The electron gun as claimed in claim 1, wherein an angle between a straight line tangent to the first and second embedding protrusions and the first axis of the electrode is within a range of 15° to 45°.

4. The electron gun as claimed in claim 1, wherein the first and second protrusions are separated by a width varying with distance from the electrode and including an inlet where the bead glass flows between the first and second embedding protrusions, the inlet having a width at least 95% of a maximum width between the first and second embedding protrusions.

5. An electron gun for a CRT comprising:

a plurality of electrodes arranged sequentially and having a plurality of electron beam passing holes; and a pair of bead glasses separated from and parallel to each other, supporting the plurality of electrodes of the electron gun, wherein one of the electrodes includes at least two electrode supports respectively embedded in the respective bead glasses, each electrode support comprising first and second embedding protrusions embedded in one of the bead glasses, the first embedding protrusion protruding further from the electrode than the second embedding protrusion, and the electrode including at least two electrode support has a depth as well as a height and includes an auxiliary electrode support embedded in one of the bead glasses and located on a surface of the electrode, facing the bead glass.

6. The electron gun as claimed in claim 5, wherein the auxiliary electrode support comprises at least two auxiliary embedding protrusions, one of the auxiliary embedding protrusions protruding farther from the electrode than the other auxiliary embedding protrusion.

7. The electron gun as claimed in claim 6, wherein an angle formed between a straight line tangent to the two auxiliary embedding protrusions and a line connecting centers of the electron beam passing holes is within a range of 15° to 45°.

8. The electron gun as claimed in claim 6, wherein the two auxiliary protrusions are separated by a width varying with distance from the electrode and including an inlet where the bead glass enters between the two auxiliary embedding protrusions, the inlet having a width at least 95% of a maximum width between the two auxiliary embedding protrusions.

9. The electron gun as claimed in claim 1, wherein the first embedding protrusion is closer to the central axis of the electrode than is the second embedding protrusion.

10. The electron gun as claimed in claim 1 wherein the electrode includes a pair of the electrode supports on each of two sides of the electrode, the first embedding protrusions of each pair of electrode supports on a respective side of the electrode being closer to each other than the second embedding protrusions of each pair of the electrode supports.

11. An electron gun for a CRT comprising:

a plurality of electrodes arranged sequentially and having a plurality of electron beam passing holes; and first and second bead glasses separated from and parallel to each other, supporting the plurality of electrodes of the electron gun, wherein at least one of the electrodes includes at feast first and second electrode supports respectively embedded in the first and second bead glasses, the first electrode support comprising a central embedding protrusion embedded in the first bead glass and first and second embedding protrusions on opposite sides of the central embedding protrusion and embedded in the first bead glass, the central protrusion protruding farther from the electrode than the first and second embedding protrusions.

12. The electron gun as claimed in claim 11, wherein the first and second electrode supports are located on opposite sides of the electrode.

13. The electron gun as claimed in claim 11, wherein each of the first and second bead glasses includes a first planar surface and second and third planar surfaces oblique to the first planar surface and generally parallel to respective tangents to the central embedding protrusion and each of the first and second embedding protrusions.

14. The electron gun as claimed in claim 11, wherein angles between straight lines tangent to the central embedding protrusion and each of the first and second embedding protrusions and a line connecting centers of the electron beam passing holes is within a range of 15° to 45°.

15. The electron gun as claimed in claim 11, wherein the first and second protrusions are separated from the central protrusion by respective embedding widths varying with distance from the electrode and including respective inlets where the bead glass flows between the first and second embedding protrusions and the central embedding protrusion, the inlets having widths at least 95% of maximum widths between the central embedding protrusion, and each of the first and second embedding protrusions.

* * * * *